United States Patent [19]

Langert

[11] Patent Number: 4,809,983

[45] Date of Patent: Mar. 7, 1989

[54] GOLF CLUB HEAD

[76] Inventor: H. Edward Langert, 5145 Avenida Encinas, Suite B, Carlsbad, Calif. 92008

[21] Appl. No.: 101,739

[22] Filed: Sep. 28, 1987

[51] Int. Cl.[4] ..... A63B 53/04; A63B 53/02

[52] U.S. Cl. ..... 273/167 E; 273/169; 273/80.2

[58] Field of Search ..... 273/80.2, 80.3, 80.4, 273/80.5, 80.6, 80.7, 80.8, 80.9, 167 E, 169, 170, 171, 172, 167 R

[56] References Cited

U.S. PATENT DOCUMENTS 1,396,470 11/1921 Taylor ..... 273/167 F
2,051,961 8/1936 Mears ..... 273/80.7
2,264,035 11/1941 Birkhofer ..... 273/80.2

FOREIGN PATENT DOCUMENTS 4326 of 1911 United Kingdom ..... 273/80.7
518007 2/1940 United Kingdom ..... 273/80.8

*Primary Examiner*—George J. Marlo
*Attorney, Agent, or Firm*—Baker Maxham & Jester

[57] ABSTRACT

A golf club head of conventional shape is provided with a thin, aerodynamically shaped shank. A hosel, in the shape of a cylinder, at the upper end of the shank is adapted to be inserted into the lower end of the club shaft.

13 Claims, 1 Drawing Sheet

GOLF CLUB HEAD

FIELD OF THE INVENTION

This invention relates generally to golf club heads and more particularly to a novel shank and hosel design for reduced mass in the shank and hosel and for reduced drag as the golf club head passes through the air.

BACKGROUND OF THE INVENTION

Golf club heads, particularly wooden heads or "metal woods," have a characteristic shape of a generally flat sole plate, a generally rounded top and a generally flat face extending between them, that face being adapted to strike the ball when the club is swung by means of a shaft. The connection between the head and the shaft is by means of a shank and a hosel. For purposes of defining terminology, the shank will be referred to as that structure extending upwardly from the body and the hosel is an extension of the shank. The shank and hosel normally flow from the head body to the connection with the shaft as a unitary structure. Both of these are typically cylindrical. The hosel is normally adapted to receive the shaft internally and the hosel and shaft are secured together in that relationship. By way of further explanation the dictionary definition of a hosel is "a socket in a golf club head into which the shaft is inserted."

By having a round shank and a hosel of sufficient size to receive the shaft therein, a certain amount of mass exists between the golf club head body and the shaft. Also, there is a certain amount of drag on a club having a shank and hosel of this shape, all of which limit the distance a ball may fly when struck with a golf club of the prior art configuration. One limitation is caused by drag which not only limits head speed but also induces instability caused by air flow around the rapidly moving round shank and hosel. Additionally, for a certain swing weight, the size and shape necessary for the conventional shank and hosel limit the mass of the golf club head body.

Swing weight may be thought of as the mass existing at the end of the shaft having to do with the "feel" to the golfer when the golfer swings the club through the position of a ball.

SUMMARY OF THE INVENTION

It is an important object of this invention to reduce drag on a golf club head as it passes through the air, thereby increasing club head speed and stability. It is a further object of the invention to increase mass in the golf club head body without increasing the swing weight. These objects are in comparison and with respect to conventional golf club heads with round shanks and hosels.

Both of the above objects are accomplished, at least in part, by making the shank substantially thinner in the dimension perpendicular to the direction of travel of the club as it passes through the position of a golf ball, while maintaining the dimension parallel to the direction of club head motion substantially the same as in prior art golf club heads. This aerodynamic configuration reduces drag and mass thereby enabling greater mass to exist in the club head body. Both factors, the aerodynamic configuration and increased body mass permitted by reduced shank mass, increase the distance a ball can be hit by a club designed in accordance with this invention. Additionally, the hosel which extends from the shank is shaped to fit within the golf club shaft thereby further reducing mass in the vicinity of the club head, permitting a greater percentage of mass to exist in the golf club head body, further increasing ball travel distance when struck by this club. The configuration of this "hosel" no longer fits the dictionary definition, but that term will continue to be used for purposes of convenience.

BRIEF DESCRIPTION OF THE DRAWING

The objects, advantages and features of this invention will be more clearly perceived from the following detailed description, when read in conjunction with the accompanying drawing, in which.

DESCRIPTION OF THE PREFERRED EMBODIMENT

Figure 1:
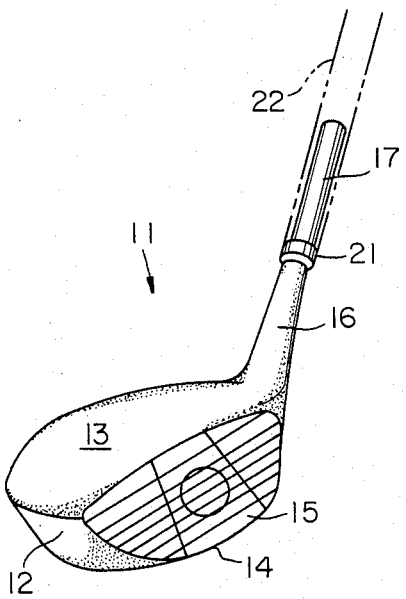
FIG. 1 is a perspective view of the golf club head constructed in accordance with this invention.

With reference now to the drawing, and more particularly to FIG. 1 thereof, there is shown golf club head 11 comprised of body 12 having rounded top 13, generally flat sole plate 14 and face 15 extending between them. Shank 16 extends generally upwardly from the body at an upper peripheral location adjacent one end of the face. Hosel 17 extends from the shank and annular shoulder 21 comprises the interface between the shank and the hosel. A portion of shaft 22 is shown in dashed lines as it would be connected to the golf club head. The body of the golf club head of this invention is substantially conventional in shape except for the shape of the shank, hosel and annular shoulder. These are the means for connecting the head body to the shaft and the transition between the shank and the golf club head body.

With reference to all of the figures of the drawing, it is readily appreciated that the shank has a substantially flat or foil configuration. Note in FIG. 5 how leading edge 23 is sharply rounded as is trailing edge 24 of the shank cross-section. The center portion or thin dimension 25 is thin compared with the distance between edges 23 and 24. The ratio between the wide dimension between the leading and trailing edges and the thin dimension should be at least two to one and is preferably between three and ten to one. The material from which the golf club head is made may dictate to a certain degree the thickness of thin dimension 25 compared with the wide dimension. However, because the greatest stress on the golf club during the swing and impact with the ball is in the wide dimension, a relatively high ratio range can normally be maintained, at least with molded materials such as metal, epoxy, fiberglass or any other material from which the golf club head is formed. The same may not be true of wood which typically has had to have a relatively large diameter shank and hosel forming the socket into which the golf club shaft is inserted.

Figure 2:
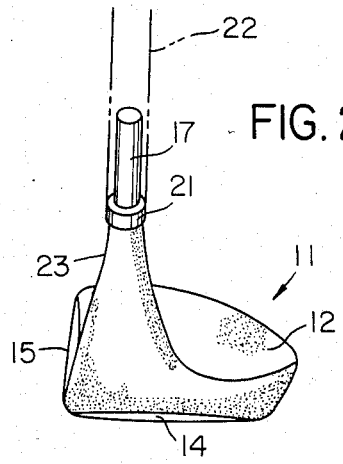
FIG. 2 is the golf club head of FIG. 1 from the rear or shank side.
Figure 3:
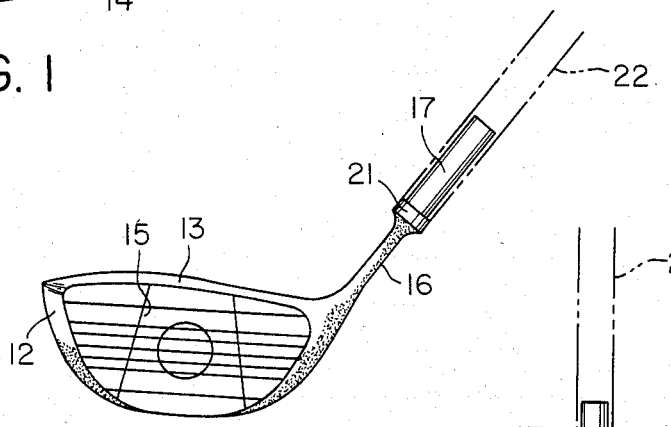
FIG. 3 is an elevational view of the golf club head of FIG. 1 from the face side.
Figure 4:
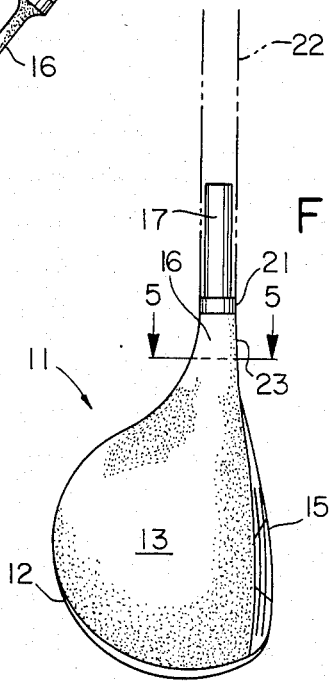
FIG. 4 is a top view of the golf club head of FIG. 1.
Figure 5:
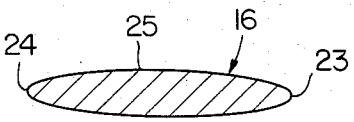
FIG. 5 is a sectional view taken along cutting plane 5—5 of FIG. 4.

With reference to FIGS. 2 and 4, it can be seen that the wide dimension of the shank at the transition location with the shaft is substantially equal to the outside diameter of the shaft and of annular shoulder 21, whereas the thin dimension as seen in FIGS. 3 and 5 is substantially less than the diameter of the shaft and annular shoulder. This leads to the conclusion that the mass of the shank is reduced by a measurable percentage and, in order to maintain swing weight, mass can be added to the club head body.

Likewise, hosel 17 is made smaller than conventional golf clubs, which is clear from the fact that the hosel is normally a part of the socket of the shank into which the shaft fits. In this case, shaft 22 fits over the hosel and is positioned by abutting annular shoulder 21. The hosel and shaft are secured together by conventional means such as epoxy or adhesive which are well known in the golf club industry. An advantage of connecting the hosel and shaft together by the hosel being relatively small and inserted into the shaft is again a reduction in mass of the golf club head at points removed from the body. In order to maintain swing weight, that mass may be added to the body.

The advantages of this structure are several. This configuration reduces the mass of the club where the shaft has historically been attached to the body, thereby permitting increased golf club head body mass. This results from a smaller hosel and reduced size of the shank.

The aerodynamic configuration of the shank permits increased speed of the club head with a given amount of energy because less drag through the air is created. Reduction of drag allows the club head to pass through the air with greater stability and increased speed.

Coupling the increased speed and greater stability with increased club head body mass results in a measurable increase in ball travel distance achieved with a club designed in accordance with this invention otherwise having the same size body and club face angle and being applied with the same amount of energy as with a conventional club having a round shank and a round hosel.

While the golf club head of this invention has been shown and described with respect to a wood type club, the design of the hosel and shank can be used as well for irons. In view of the above description, it is likely that modifications and improvements will occur to those skilled in the art which are within the scope of the appended claims.

What is claimed is:

1. A golf club head having a body formed with a rounded top, a generally flat sole plate and a generally flat vertically oriented ball striking face extending between the top and the sole plate, said golf club head comprising:

a shank extending generally upwardly from said body at one upper peripheral location thereon, the longitudinal axis of said shank extending in a direction generally parallel to the plane of said face; and hosel means extending axially upward from said shank, said hosel means providing means for connecting said golf club head to an elongated shaft, said hosel means being formed generally as a cylinder;

said shank having a cross section which is relatively thin in one plane and relatively wide in another plane generally perpendicular to said one plane, thereby forming a foil configuration which is symmetrical about said longitudinal axis with a long axis through said wide plane extending between a leading edge of said foil through a trailing edge, said leading edge being adjacent said face, said long axis being generally perpendicular to said face;

whereby the shape of said shank results in reduced drag as the golf club head passes through the air and an improved ratio of body mass to shank mass, both as compared with a golf club head having a round shank, thereby resulting in more mass at greater speed for the same energy applied to swinging the club.

2. The golf club head recited in claim 1, wherein the wide dimension of said shank is at least two times the width of the thin dimension.

3. The golf club head recited in claim 1, wherein the wide dimension of said shank is at least three times the width of the thin dimension.

4. The golf club head recited in claim 1, wherein the wide dimension of said shank is at least four times the width of the thin dimension.

5. The golf club head recited in claim 1, wherein the wide dimension of said shank ranges between two and ten times the width of the thin dimension.

6. The golf club head recited in claim 1, wherein at the point of connection with the shaft the wide dimension of said shank is sufficiently wide to equal the diameter of a conventional golf club shaft to which said hosel means is adapted to connect.

7. The golf club head recited in claim 6, wherein said shank expands smoothly in the wide dimension to blend into the surface of said body.

8. The golf club head recited in claim 6, wherein the thin dimension of said shank is substantially less than the diameter of the conventional shaft to which said hosel means is adapted to connect.

9. The golf club head recited in claim 8, wherein the thin dimension of said shank is substantially constant between said hosel means and the point of connection to said body.

10. The golf club head recited in claim 1, wherein said hosel means is shaped and configured to extend a predetermined distance into a golf club shaft.

11. The golf club head recited in claim 10, and further comprising an annular shoulder between said shank and said hosel means, thereby providing a seat for the end of the shaft to which said golf club head is adapted to be connected.

12. The golf club head recited in claim 11, wherein the diameter of said annular shoulder is substantially equal to the diameter of the shaft to which said body is adapted to be connected and is substantially equal to the wide dimension of said shank at the point of joinder of said hosel and said shank.

13. A golf club head having a body formed with a somewhat rounded top, a generally flat sole plate and a generally flat vertically oriented ball striking face extending between the top and the sole plate, said golf club head comprising:

a shank extending generally upwardly from said body at one upper peripheral location thereon, the longitudinal axis of said shank extending in a direction generally parallel to the plane of the face from a position adjacent one end of the face;

a hosel extending axially upward from said shank, said hosel providing means for connecting said golf club head to a conventional golf club, said hosel being formed generally as a cylinder and adapted to fit within the shaft; and an annular shoulder between said shank and said hosel providing stop means for the shaft as it telescopically connects with said hosel;

said shank having a cross section which is relatively thin in one plane and relatively wide in another plane generally perpendicular to said one plane thereby forming a foil configuration which is symmetrical about said longitudinal axis with a long axis through said wide plane extending between a leading edge of said foil through a trailing edge, said leading edge being adjacent said face, said long axis being generally perpendicular to said face, the ratio of the wide dimension to the thin dimension ranges between two and ten, the wide dimension of said shank is sufficiently wide to equal the diameter of a conventional golf club shaft at the point of connection with the shaft and the wide dimension increases in width closer to said body to blend smoothly into the surface of said body, the thin dimension being substantially less than the diameter of the conventional shaft at the point of connection;

whereby the shape of said shank results in reduced drag as the golf club head passes through the air and an improved ratio of body mass to shank mass, both as compared with a golf club head having a round shank, thereby resulting in more mass at greater speed for the same energy applied to swinging the club.

* * * * *